US007765907B2

(12) United States Patent
Meyer

(10) Patent No.: US 7,765,907 B2
(45) Date of Patent: Aug. 3, 2010

(54) TRIMMING DEVICE FOR TRIMMING A LATERAL EDGE

(75) Inventor: Hanspeter Meyer, Hüttwilen TG (CH)

(73) Assignee: Müller Martini Holding AG, Hergiswil (CH)

( * ) Notice: Subject to any disclaimer, the term of this patent is extended or adjusted under 35 U.S.C. 154(b) by 331 days.

(21) Appl. No.: 11/730,847

(22) Filed: Apr. 4, 2007

(65) Prior Publication Data

US 2007/0227323 A1 Oct. 4, 2007

(30) Foreign Application Priority Data

Apr. 4, 2006 (EP) ..... 06405142

(51) Int. Cl.
*B26D 7/18* (2006.01)

(52) U.S. Cl. ..... 83/99; 83/109

(58) Field of Classification Search ..... 83/24, 83/98, 99, 109, 149, 162–165, 904, 917
See application file for complete search history.

(56) References Cited

U.S. PATENT DOCUMENTS

| | | | | |
|---|---|---|---|---|
| 535,784 | A * | 3/1895 | Barber | 83/164 |
| 3,424,044 | A * | 1/1969 | Jardins et al. | 83/255 |
| 4,445,409 | A * | 5/1984 | Mohr et al. | 83/157 |
| 4,850,257 | A * | 7/1989 | Mohr | 83/93 |
| 5,209,149 | A * | 5/1993 | Mohr | 83/91 |
| 5,279,196 | A * | 1/1994 | Mohr | 83/91 |
| 5,377,569 | A * | 1/1995 | Richards et al. | 83/98 |
| 5,379,668 | A * | 1/1995 | Standing | 83/99 |
| 2004/0112195 | A1 * | 6/2004 | Lorenzi | 83/546 |

FOREIGN PATENT DOCUMENTS

| | | | |
|---|---|---|---|
| DE | 3444952 | A1 | 7/1985 |
| DE | 3713897 | A1 | 11/1987 |
| DE | 8716354.3 | U1 | 12/1987 |
| DE | 3829682 | A1 | 3/1989 |
| DE | 19621872 | C1 | 8/1997 |
| EP | 0 056 874 | A2 | 12/1981 |

OTHER PUBLICATIONS

European Search Report dated Sep. 13, 2006.

* cited by examiner

*Primary Examiner*—Boyer D. Ashley
*Assistant Examiner*—Edward Landrum
(74) *Attorney, Agent, or Firm*—Venable LLP; Robert Kinberg; Steven J. Schwarz

(57) ABSTRACT

A trimming apparatus for trimming a lateral edge a printed product includes a trimming table arranged to receive the printed product in a position ready for trimming. A trimming knife is configured to cut the lateral edge of the printed product during a cutting stroke, thereby creating cuttings separated from the print product. A removal device is provided for removing the separated cuttings. The removal device includes a collection region arranged behind the trimming knife to receive the separated cuttings during the cutting stroke of the trimming knife and a plurality of air nozzles located above the collection region. The nozzles are adapted to blow compressed air into the collection region to remove the separated cuttings through the collection region.

11 Claims, 4 Drawing Sheets

15
19
5
18
23
2
3
13
25
14
11
7
10
1
12
36
31
33
24
30
8
22
9

TRIMMING DEVICE FOR TRIMMING A LATERAL EDGE

CROSS-REFERENCE TO RELATED APPLICATION

This application claims the priority of European Patent Application No. 06405142, filed on Apr. 4, 2006, the subject matter of which is incorporated herein by reference by its entirety.

BACKGROUND OF THE INVENTION

1. Field of Invention

The present invention relates generally to trimmers, and more particularly to a device for trimming a lateral edge of printed products.

2. Description of the Related Art

Following the binding of printed material, such as books, book blocks, brochures, and similar printed products, the unfinished printed material are trimmed to a specified size using a trimming device. Conventional trimming devices are usually positioned at the end of a production line, along which the printed products are sequentially gathered, bound, trimmed and stacked. Such conventional trimmers may also be known as three-knife trimmers. A distinction is often made between trimming methodology by which the trimming devices trim the printed material, i.e., devices operating based on the knife and counter-knife methodology (i.e. the shearing principle), versus those operating with a trimming knife swinging against a softer cutting bar. Regardless of the trimming or cutting methodology, the printed products must first be transported with a conveying system to the trimming position, aligned precisely in this position, and held down securely before the trimming operation can be realized. Once the product has been trimmed, the holding down force is deactivated and the printed product is removed from the trimming region to make way for the next product that arrives. Additional means are required for removing the cuttings generated during the trimming operation. If the cuttings are left in place, for example, they can hinder the alignment of the next printed product to be trimmed, thus resulting in a reduced trimming accuracy or even in unusable printed products. It is also conceivable that the cuttings may be carried along by the printed products and interfere with the ensuing processing operations. The situation is particularly critical when the cuttings are removed from trimming apparatuses where the trimming knives are positioned transverse to the conveying direction for the printed products because the available space must be used for conveying the printed products as well as for removing the cuttings. The requirements to be met for removing the cuttings increase further with higher clocking times and/or shorter cycle times, with increased thickness of the product to be cut, and with wider sections. Present-day trimming apparatuses cannot be operated reliably without auxiliary devices for removing the cuttings.

One widespread conventional solution provides for the use of compressed air nozzles, which are mounted on the movable trimming knife or parts close to the trimming knife and thus follow the movement of the knife. In the process, the compressed air is directed along the back side of the trimming knife and toward the cutting edge of the blade, blowing the cuttings away from the trimming knife. Additional compressed air nozzles, which are also mounted on the trimming knife and are directed toward a collecting cone on a device for suctioning off cuttings, are intended to accelerate the movement of the cuttings for the transport into this cone. This solution, however, has a disadvantage in that the compressed air nozzles directed toward the collecting cone are positioned so far away from the generated cuttings that their effect is inadequate. Further, as a result of air turbulences that form, the removal of cuttings in the direction of the collecting cone is too slow, thus the collisions with the following printed product to be trimmed is often not prevented.

According to a different solution, disclosed in German patent document DE 37 13 897 A1, which is incorporated herein by reference in its entirety, a guiding device with a downward pointing compressed air nozzle for removing the cuttings is mounted on the trimming knife and/or the knife holder itself. Although this solution may be adequate for small sections and long cycle times, as a result of the compressed air that is directed toward the cutting surface of the trimming knife, the cuttings are swirled around in the cutting space that is open toward the bottom and are conveyed away in downward direction with a delayed effect.

The aforementioned devices furthermore have the disadvantage that the elements intended for removing the cuttings, such as compressed air nozzles and guiding devices, are mounted directly on the trimming knife or the knife holder and always occupy the same position relative to the trimming knife. Therefore, these elements move along a curve, analog with the trimming knife, determined by the swing cut of the trimming knife. This limitation strongly curtails the design choices for these elements because of the need to prevent collisions with the devices necessary for conveying the printed products to the trimming table.

SUMMARY OF THE INVENTION

It is an object of the invention to provided a trimming apparatus that removes cuttings generated during a trimming of print products continuously and without dust from the trimming region, in particular the cuttings generated during a lateral trimming of the print product.

The above and other objects are accomplished according to the invention, wherein in one embodiment there is provided a trimming apparatus for trimming a lateral edge of at least one printed product, comprising: a trimming table arranged to receive the printed product in a position ready for trimming; a trimming knife configured to cut the lateral edge of the printed product during a cutting stroke, thereby creating cuttings separated from the print product; and a removal device for removing the separated cuttings, the removal device comprising: a collection region arranged behind the trimming knife to receive the separated cuttings during the cutting stroke of the trimming knife; and a plurality of air nozzles located above the collection region and adapted to blow compressed air into the collection region to remove the separated cuttings through the collection region.

BRIEF DESCRIPTION OF THE DRAWINGS

These and other features and advantages of the invention will be further understood from the following detailed description of the preferred embodiments with reference to the accompanying drawings, showing in.

DETAILED DESCRIPTION

Figure 1:
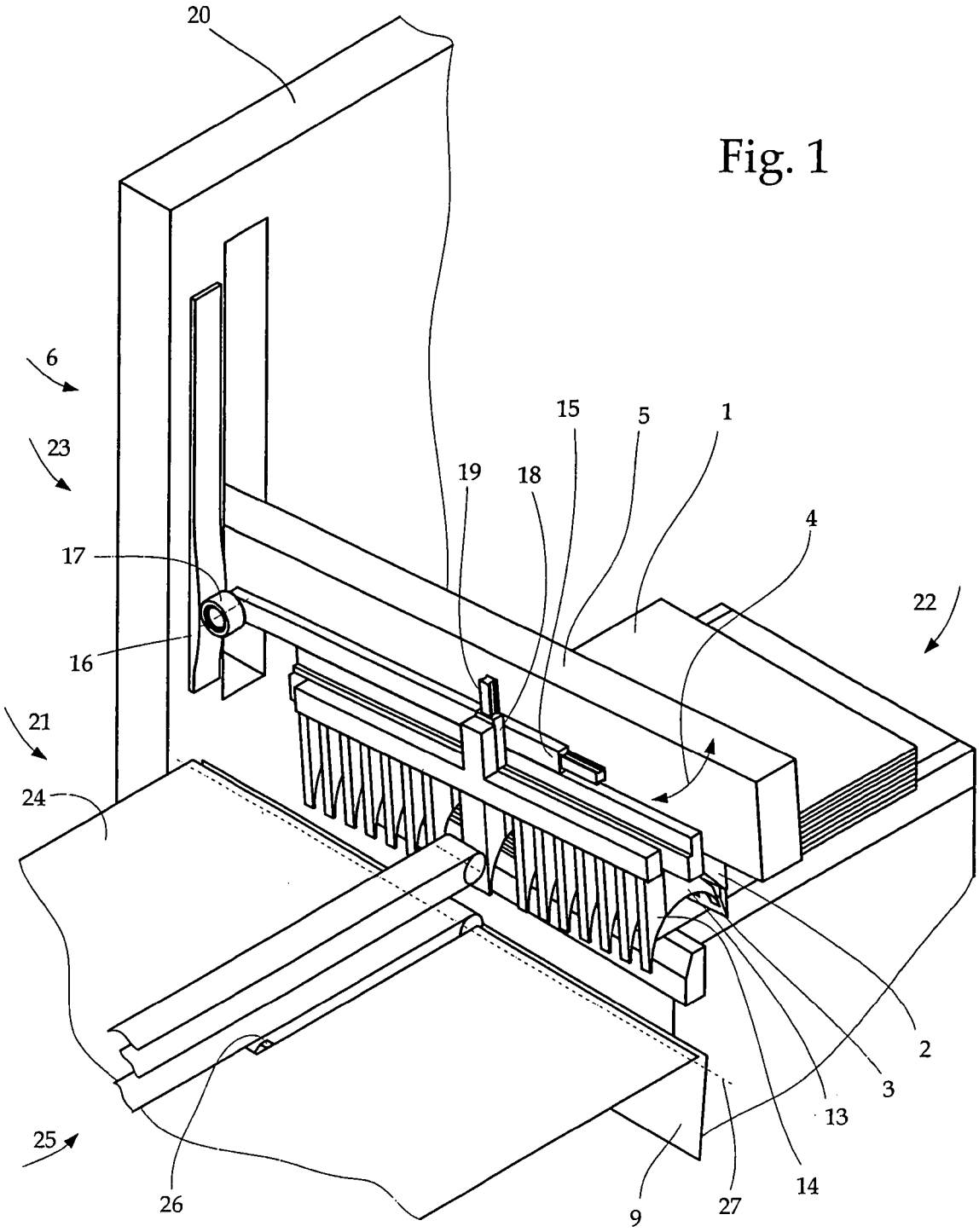
FIG. 1 depicts a simple three-dimensional representation of a front-edge trimming device on a three-knife trimmer, shown in a position ready for trimming.

FIGS. 1 to 4 show a trimming device 23, such as a three-knife trimmer, for trimming a lateral edge (e.g., the front edge) on a printed product 1, such as a book, a brochure, a magazine or the like, according to an embodiment of the present invention. In this embodiment, a feeding device 21 and a trimming table 22 may be arranged on a stationary machine frame 20. The trimming knife 3, which may be attached to a knife holder 2, moves at least during the trimming operation in vertical and horizontal directions inside a cutting plane. The trimming knife 3 may consequently move along a movement path indicated by the arrow 4. The knife holder 2 may be attached using conventional means, such as screws, to a knife holder support 5 guided at both ends inside a guiding device 6 of the machine frame 20. The knife holder support 5 may be operated by a drive (not shown in FIG. 1). Guide elements (not shown) may be provided to ensure that the trimming knife 3, the knife holder 2, and the knife holder support 5 all move in the direction of arrow 4. The printed product 1 may be held down on the trimming table 22 using a pressing die 7 (shown in FIGS. 3-4), at least during the trimming process. The pressing die 7 may be provided to prevent the printed products 1 from moving as a result of the forces generated during the trimming operation. A counter-knife or a cutting-bar 30 may further be provided to absorb the stroke of the trimming knife 3 on the trimming table 22.

The feeding device 21, positioned ahead of the trimming device 23, may move the printed products 1 onto the trimming table 22. In one embodiment, the feeding device 21 may include a table 24 on which the printed products 1 rest while they are conveyed to the trimming device 23 via a conveyor belt 25, which moves the printed products 1 towards the trimming device 23, and a pusher 26, which moves the printed products 1 onto the trimming table 22 for trimming.

Figure 2:
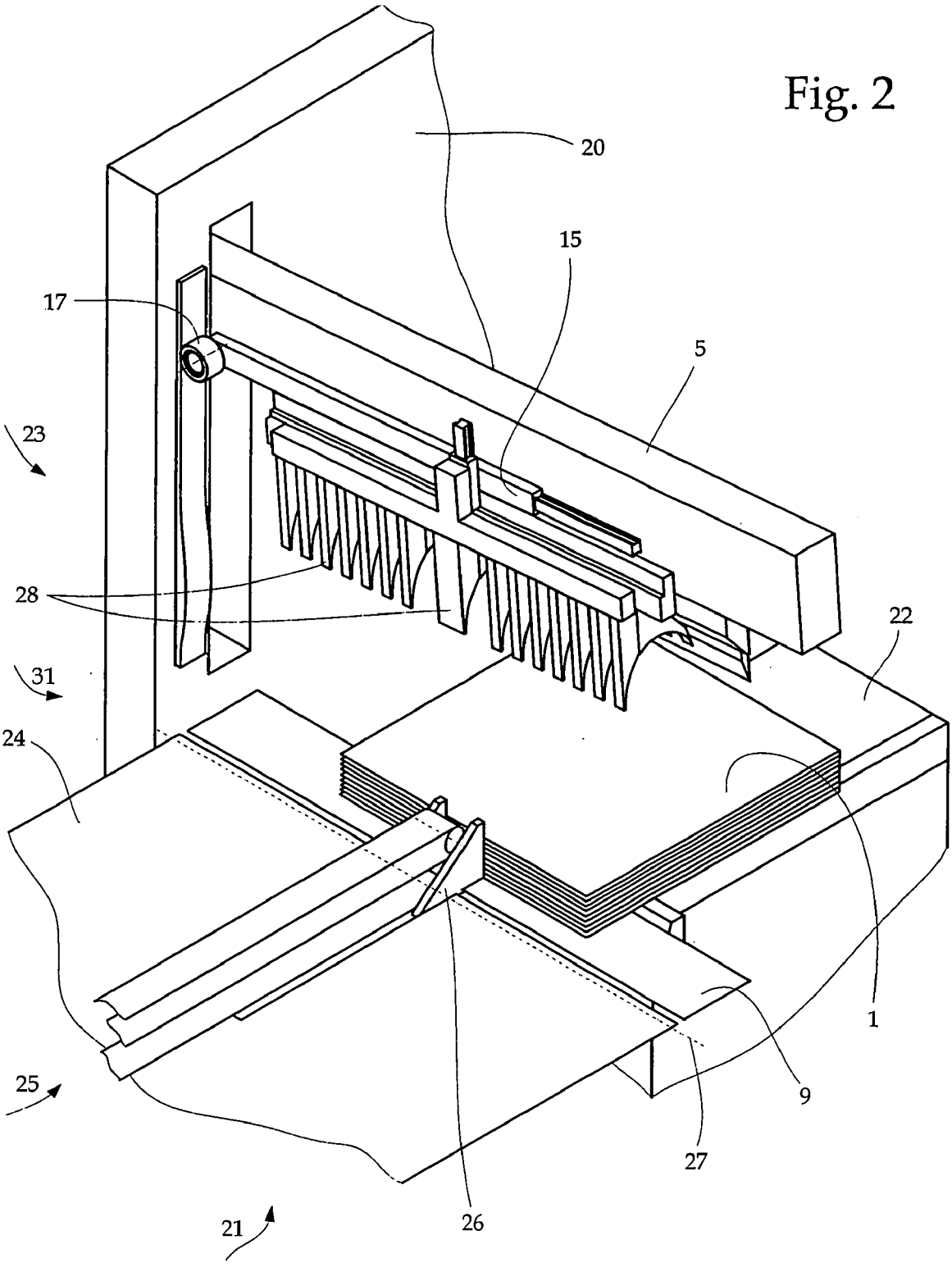
FIG. 2 depicts the trimming device shown in FIG. 1, with raised trimming knife and a printed product in the position ready for the trimming.

In embodiments of the invention, in order to remove the trimmed-off cuttings 8 (shown in FIGS. 3-4) in a downward direction, it may be required for the end of the table 24 that faces the trimming table 22 to move away from the trimming device 23, thereby creating a sufficiently large space through which the cuttings 8 are removed. In the embodiment shown in FIG. 1-2, the end of the table 24 is configured to include a flap 9 that is positioned so as to pivot around an axis 27. During the conveying of printed products 1, as shown in FIG. 2, the flap 9 forms the end of the table 24. On the other hand, during the trimming operation, as shown in FIG. 1, the flap is pivoted downward to open up a gap through which the cuttings 8 are removed. Conventional operating mechanisms generally known in the related art, such as control cams, electric, hydraulic, or pneumatic drives, may be used for the cyclical control of the flap 9.

Figure 3:
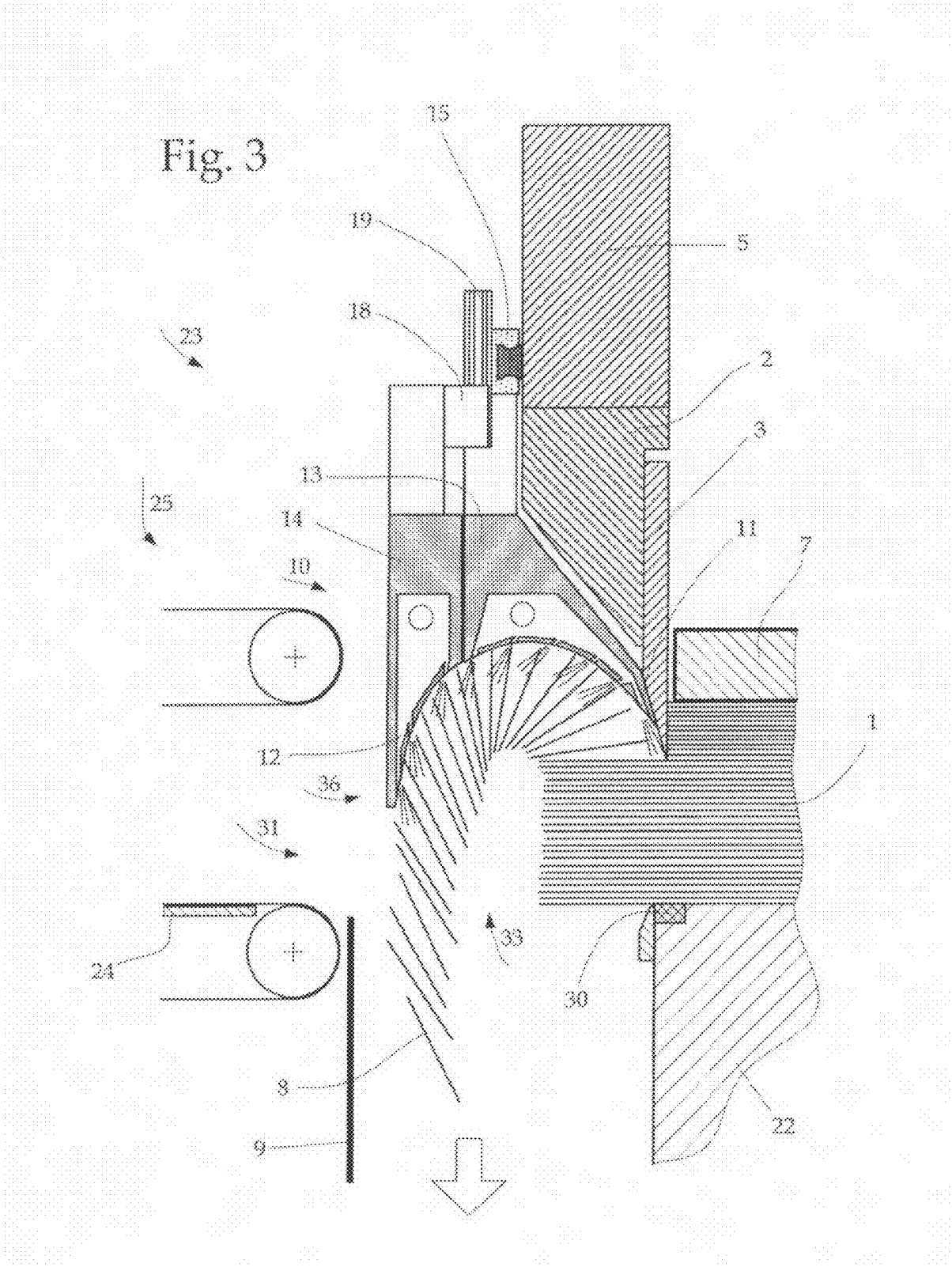
FIG. 3 illustrates a cross-section through the trimming region of the trimming device shown in FIG. 1.
Figure 4:
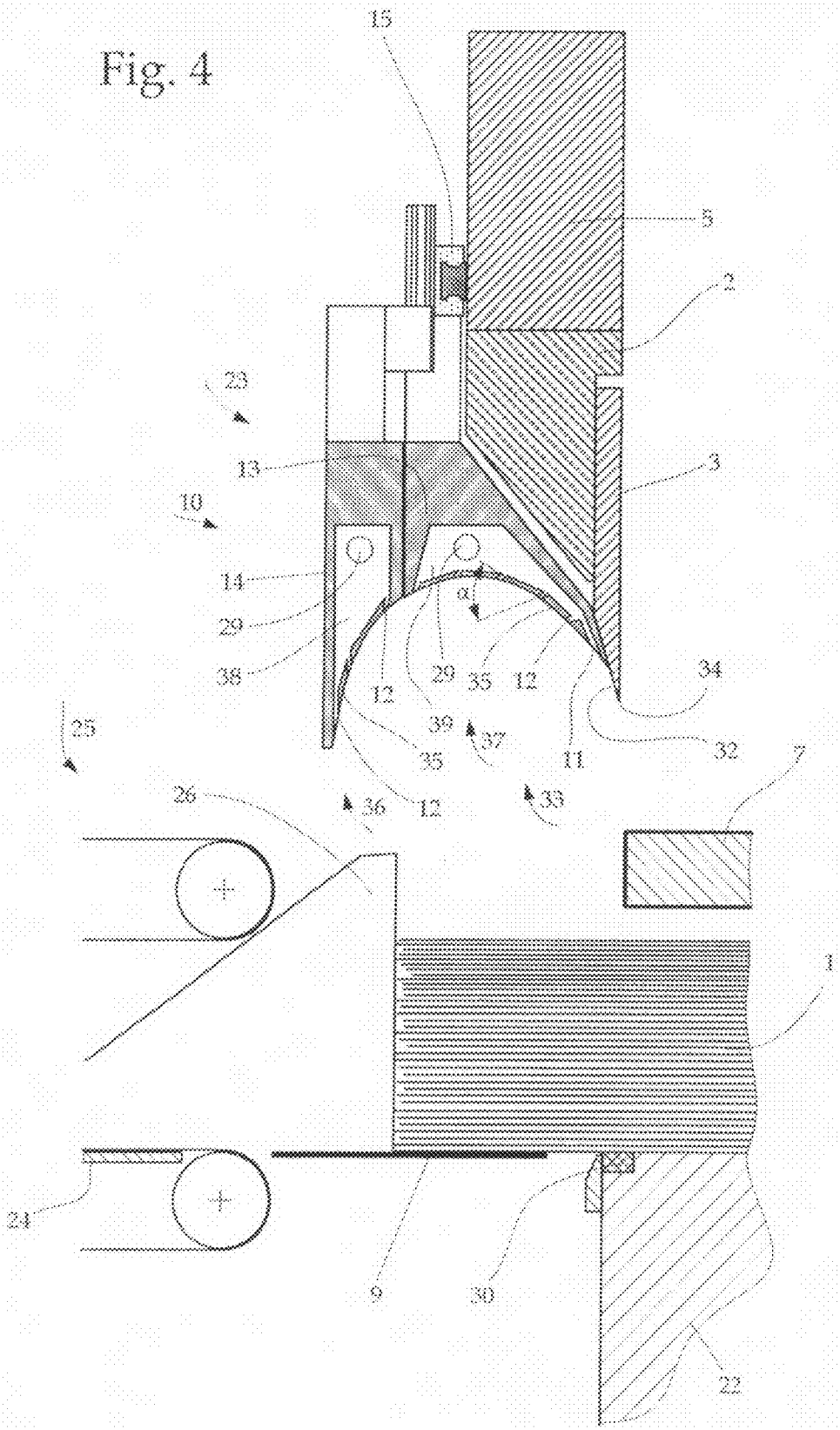
FIG. 4 illustrates a cross-section through the trimming device shown in FIG. 2.

FIGS. 3 and 4 show the generating of the conveying effect and the removal of the trimmed-off cuttings 8. Since the pages of a printed product 1 generally are not affixed to each other in the front by folds or other means, that cuttings 8 may be continuously generated from the printed products 1 and need to be removed quickly during the trimming operation. In this embodiment, compressed air flowing out of the nozzles 11 flushes the cuttings 8 from the trimming knife 3 and removes these from the trimming region. A special arrangement may be provided, in which the nozzles 11 are arranged approximately parallel to the back 32 of the trimming knife 3 and the conveying nozzles 12 are arranged at an acute angle $\alpha$ to the surface of the guide walls 35, which jointly form a collection region 33 for collecting the cuttings 8. The device 31 for removing the cuttings, e.g. a suction device, can be used for the further transport of the cuttings 8. The compressed air is fed to the nozzles 11, 12 from the compressed air chambers 38, 39, wherein these chambers are connected via connections 29 to a compressed air source (not shown herein). The effect of this nozzle arrangement is to flush the trimmed cuttings 8 from the trimming region into a compressed air flow that is parallel to the trimming plane, so that the cuttings 8 are conveyed out of the trimming region. The air supply may be activated only long enough for the cuttings 8 to be removed. The cuttings 8 may then be transported off continuously and immediately after they are generated to prevent the forming of a jam, in particular during the trimming of wide cuttings 8 from thick printed products 1.

In embodiments of the invention, as shown in FIG. 1-4, a guide element 10 may be provided with a guide element region 37 that may face the cuttings 8 and may extend from above the cutting edge 34 in a constantly curved shape (for example an arch shape) toward the end 36, which may be located below the cutting edge 34, thereby forming a collection region 33 for collecting the cuttings 8. In further embodiments, the guide element 10 may be provided with two parts: a curved part 13 that is closest to the trimming knife 3 and may be connected to it in a vertical direction via a slide 15, which is displaceable in a longitudinal direction of the knife 3; and a curved part 14 that is farther away from the trimming knife 3 and may be embodied such that it can be raised vertically upward toward the curved part 13 via a sliding part 18 on a rail 19. Using this embodiment, possible collisions between a printed product 1, that is not yet moved completely onto the trimming table 22, and the second curved part 14 can be avoided.

In a further embodiment of the invention, in order to prevent the guide element 10 from colliding with the elements of the feeding device 21, such as the belt conveyor 25 or the pusher 26, the guide element 10 may be divided into a plurality of segments 28 across the length of the trimming knife 3 (FIG. 2). The advantage of dividing the guide element 10 into segments 28 is that only enough segments 28 need to be installed as are required by the cutting length. To keep the gaps between the segments 28 as narrow as possible, the guide element 10 may be connected via the slide 15 to the knife holder 2 or the knife holder support 5. As the knife holder support 5 moves the trimming knife 3 sideways during the trimming operation, the guide element 10 may be guided via a guide roll 17 along a control curve 16 (FIG. 1) such that the guide element 10 moves sideways along with the trimming knife 3 during the trimming operation.

The invention has been described in detail with respect to various embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A trimming apparatus for trimming a lateral edge of at least one printed product, comprising:

a trimming table arranged to receive the printed product in a position ready for trimming;

a trimming knife having a cutting edge configured to cut the lateral edge of the printed product during a cutting stroke, thereby creating cuttings separated from the print product; and a removal device for removing the separated cuttings, the removal device comprising:

a guide element arranged next to the trimming knife, the guide element comprising a continuous arch-shaped guide wall that extends upward from a first end located proximate to the cutting edge to a second end spaced apart from the cutting edge and located below the cutting edge, wherein the arch-shaped wall in the guide element defines a collection region arranged behind the trimming knife to receive the separated cuttings during the cutting stroke of the trimming knife; and a plurality of air nozzles arranged in the guide wall, the plurality of nozzles located above the collection region and adapted to blow compressed air into the collection region to remove the separated cuttings through the collection region.

2. The trimming apparatus of claim 1, further comprising a pressing die configured to hold down the printed product on the trimming table during the trimming of the printed product.

3. The trimming apparatus of claim 1, further comprising at least one of a counter knife and a cutting bar, configured to absorb the stroke of the trimming knife on the trimming table.

4. The trimming apparatus of claim 1, wherein the guide element is drive-connected to the trimming knife.

5. The trimming apparatus of claim 4, wherein the trimming knife is arranged to have a curved movement in a vertical and horizontal direction during a cutting stroke.

6. The trimming apparatus of claim 5, further comprising a control curve along which the guide element moves during the cutting stroke, the control curve being configured to impart horizontal movement to the guide element corresponding to movement of the trimming knife in the horizontal direction during the cutting stroke.

7. The trimming apparatus of claim 1, wherein the second end of the guide wall is located remotely from the trimming knife in a horizontal direction and below the cutting edge in a vertical direction.

8. The trimming apparatus of claim 7, wherein at least one of the plurality of nozzles in closer proximity to the second end of the guide wall than to the first end of the guide wall is arranged approximately parallel to a cutting plane formed by the trimming knife.

9. The trimming apparatus of claim 1, wherein at least some of the nozzles are disposed at an acute angle to a downward direction.

10. The trimming apparatus of claim 1, wherein the guide element further comprises at least one air chamber arranged to be coupled to a source of compressed air, wherein the air chamber is arranged above the guide wall to provide compressed air to the nozzles.

11. The trimming apparatus of claim 1, wherein the guide element comprises a first curved part and a second curved part, the first curved part is arranged in close proximity of the trimming knife, and the second curved part is farther removed from the trimming knife and is detachable from the first curved part for movement in the vertical direction relative to the first curved part.

* * * * *